United States Patent [19]

Lepley et al.

[11] 4,452,447

[45] Jun. 5, 1984

[54] ANKLE EXERCISER

[75] Inventors: Chelsea Lepley, Denton; J. Scott LaCroix, Irving, both of Tex.

[73] Assignee: Isotechnologies, Inc., Carrboro, N.C.

[21] Appl. No.: 242,888

[22] Filed: Mar. 12, 1981

Related U.S. Application Data

[63] Continuation-in-part of Ser. No. 172,184, Jul. 7, 1980, abandoned.

[51] Int. Cl.[3] ..... A63B 23/04

[52] U.S. Cl. ..... 272/96; 73/381; 36/11.5

[58] Field of Search ..... 272/96, 130, DIG. 1, 272/138, 132, 119, 144, 143, 146, 129, 97; 128/25 B, 25 R; 73/379, 380, 381

[56] References Cited

U.S. PATENT DOCUMENTS

| | | | |
|---|---|---|---|
| D. 242,732 | 12/1976 | Brentham . | |
| D. 251,320 | 3/1979 | Brentham . | |
| D. 255,136 | 5/1980 | Brentham . | |
| 2,183,465 | 12/1939 | Noor . | |
| 2,206,902 | 7/1940 | Kost . | |
| 2,565,348 | 8/1951 | Brockman et al. . | |
| 3,020,046 | 2/1962 | Hotas | 272/96 |
| 3,318,304 | 5/1967 | Gurewich . | |
| 3,369,403 | 2/1968 | Carlin et al. . | |
| 3,465,592 | 9/1969 | Perrine . | |
| 3,495,824 | 2/1970 | Cuinier | 272/130 |
| 3,572,700 | 3/1971 | Mastropaole . | |
| 3,580,244 | 5/1971 | Graves . | |
| 3,702,188 | 11/1972 | Phillips | 272/130 |
| 3,758,112 | 9/1973 | Crum | 272/130 |
| 3,822,599 | 7/1974 | Brentham . | |
| 4,066,259 | 1/1978 | Brentham . | |
| 4,185,818 | 1/1980 | Brentham | 272/130 |
| 4,226,415 | 10/1980 | Wright | 272/130 |
| 4,306,714 | 12/1981 | Loomis | 272/126 |
| 4,337,050 | 6/1982 | Engalitcheff | 272/130 |

*Primary Examiner*—Richard J. Johnson

*Attorney, Agent, or Firm*—Richards, Harris & Medlock

[57] ABSTRACT

An ankle exerciser (10) is disclosed for permitting isokinetic exercise of the ankle joint of the user. The foot of the user is secured to a foot plate (54) by a strap (124). The foot plate is capable of motion about three mutually perpendicular axes (X—X, Y—Y, Z—Z), with one axis corresponding to the axis of pivotal motion of the ankle joint in dorsal and plantar flexion. The motion about each axis is restricted by a double acting fluid cylinder (64, 82, 104). Individual metering valves (160, 162, 164) are provided for restricting flow between the chambers of the cylinders and a reservoir (152) to selectively determine the desired resistance to motion. Pressure gauges (154, 156, 158) are associated with each of the fluid cylinders to indicate the force exerted by the user resisted by the particular fluid cylinder. In a second embodiment, an ankle exerciser (250) is provided for exercising both ankles of the user. The foot plates (282, 284) are provided with straps to secure the feet of the user thereon. The foot plates are mounted for motion about an axis (V—V) which substantially corresponds to the axis of pivotal motion of the ankle joints in dorsal and plantar flexion. A fluid cylinder (296) and metering valves (304, 306) permit resistance to motion of the foot plates and permit the resistance in each direction to be independently determined. Pressure gauges (300, 302) are provided for monitoring the force exerted by the user.

22 Claims, 11 Drawing Figures

ANKLE EXERCISER

CROSS-REFERENCE TO RELATED APPLICATION

This application is a continuation-in-part of co-pending application Ser. No. 172,184 filed July 7, 1980 now abandoned.

TECHNICAL FIELD

This invention relates to rehabilitative and exercising devices, in particular to devices for testing, rehabilitating and exercising the ankle.

BACKGROUND ART

Three general types of exercise have been recognized, isotonic, isometric and isokinetic. The isotonic exercise involves contraction of the muscles against a fixed resistance or load. As a result of the variable length of lever arm formed by the bone structure in the human body, the forces that must be exerted by the muscles vary while the load remains constant. Therefore, the load must be selected to permit movement during the weakest portion of the body motion and the muscles undergo the strongest contractions only during a short portion of the total movement in the body.

Isometric exercises involves the muscular exertion of portions of the body against a load which is stationary and immobile. While this type of exercise permits the maximum contraction of the muscles employed, the body is prevented from any motion.

Isokinetic exercise resolves the problems noted above with isotonic and isometric exercising. In isokinetic exercising, the muscles of the body exert a force against a load or resistance which is moving at essentially a constant velocity and relatively independent of the actual force exerted by the muscles. Therefore, for rehabilitation and exercise of a portion of the body, such as the ankle and lower leg, a device permitting isokinetic exercises would be most preferable.

The human foot is capable of a wide range of motion provided by the ankle joint and lower leg. The major motion provided by the ankle joint is dorsal and plantar flexion. In plantar flexion, the foot is pivoted about the ankle joint to move the toes downward below the ankle. This is done when a person stands on their toes. In dorsiflexion, the foot is pivoted about the ankle joint to draw the toes upward above the heel.

The ankle joint also permits limited motion in inversion and eversion. In inversion, the soles of both feet would move toward each other if both feet are inverted simultaneously. In eversion, the soles of the feet would move away from each other if both feet were evered simultaneously.

Finally, the foot and ankle joint may be rotated about an axis extending through the ankle joint and heel by the action of the tibia and fibula, the bones forming the lower leg.

DISCLOSURE OF THE INVENTION

In accordance with the present invention, an apparatus for exercising an ankle is disclosed. The apparatus includes a frame and a pedal assembly pivotally mounted to the frame for motion about at least one axis. The axis corresponds substantially to the axis of pivotal motion of the ankle joint in plantar and dorsal flexion. A foot may be secured to the pedal assembly by a strap. Resistance means is provided to resist the pivotal motion of the pedal assembly about the axis. Finally, control means are provided for selecting the resistance to motion about each axis.

In accordance with another aspect of the present invention, an apparatus is provided for exercising the ankles of a user. The apparatus includes a frame and a pedal assembly including strap means for securing the feet of the user in mutual alignment. The pedal assembly is pivotally mounted to the frame for motion about an axis generally corresponding to the axis of pivotal motion of the ankles of the user in dorsal and plantar flexion. Resistance means are provided to resist the pivotal motion of the pedal assembly and control means are provided for selecting predetermined resistance to motion.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
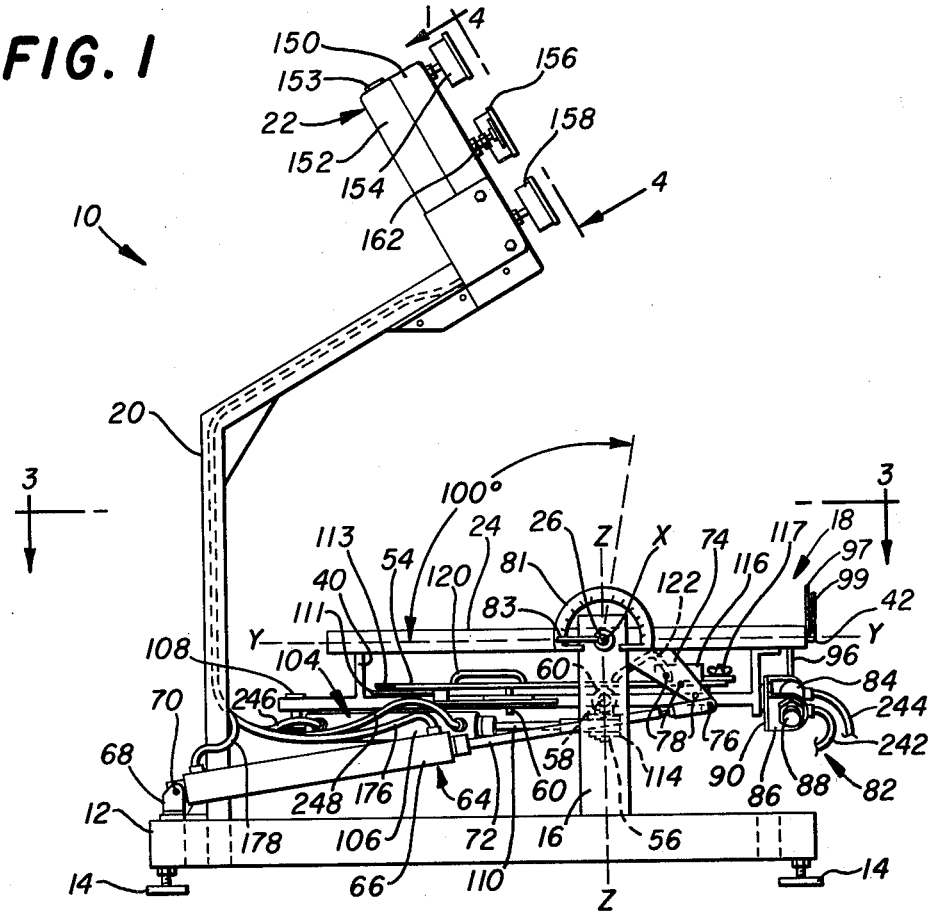
FIG. 1 is a side view of an ankle exerciser forming a first embodiment of the present invention.

Referring now to the Drawings, wherein like reference characters designate like or corresponding parts throughout several views, FIGS. 1–5 illustrates an ankle exerciser 10 employing the features of the present invention. The ankle exerciser 10 includes a support frame 12 formed of structural members defining a rectangle and supported on adjustable feet 14 positioned at each corner of the frame 12. Members 16 extend vertically upward from side portions of the frame 12 to pivotally mount a pedal assembly 18 for rotation about an axis X—X. A control column 20 is rigidly secured to the rear member of frame 12 and extends vertically upward and forward to support a control panel 22.

The pedal assembly 18 includes a main frame 24 pivotally mounted to the member 16 by pivot shafts 26 and 28 supported by bushings 30 and 32 within members 16.

Spacers 34 and 36 may be secured between frame 24 and members 16 to reduce movement of the frame between the members 16.

A bridge plate 40 is pivotally connected to the front and rear portions of frame 24 by means of pivot shafts 42 and 44 cooperating with bushings 46 and 48 mounted within frame 24. This permits pivotal motion of the bridge plate 40 about a second axis, Y—Y, relative to the frame 24.

A foot plate 54, in turn, is pivotally secured to bridge plate 40 by pivot pin 56 for pivotal motion about a third axis Z—Z. The underside of the foot plate 54 includes structure to support axles 58 and guide wheels 60 which contact the upper surface of bridge plate 40. This insures proper spacing between the foot plate 54 and bridge plate 40 and eliminates any restriction to rotation about axes Z—Z which may arise from binding between the pivot pin 56 and plates 40 and 54.

A first double acting linear fluid cylinder 64 is interconnected between the rear of the support frame 12 and the main frame 24. The housing 66 of cylinder 64 is pivotally connected at its end to pivot bracket 68 mounted on support frame 12 by a pivot pin 70. The exposed end of the piston rod 72 of cylinder 64 is pivotally connected to pivot arm 74 mounted on main frame 24 by a pivot pin 76 positioned in one of the plurality of holes 78 formed within the pivot arm 74. It can be readily seen that movement of the pedal assembly 18 about axis X—X may be controlled by cyliner 64. A protractor scale 81 may be secured to one member 16 for cooperation with a pointer 83 on pivot shaft 26 to indicate the angle of tilt about axis X—X. In the preferred embodiment, the range of motion permitted by cylinder 64 comprises an arc of approximately 100° as shown in FIG. 1.

Figure 2:
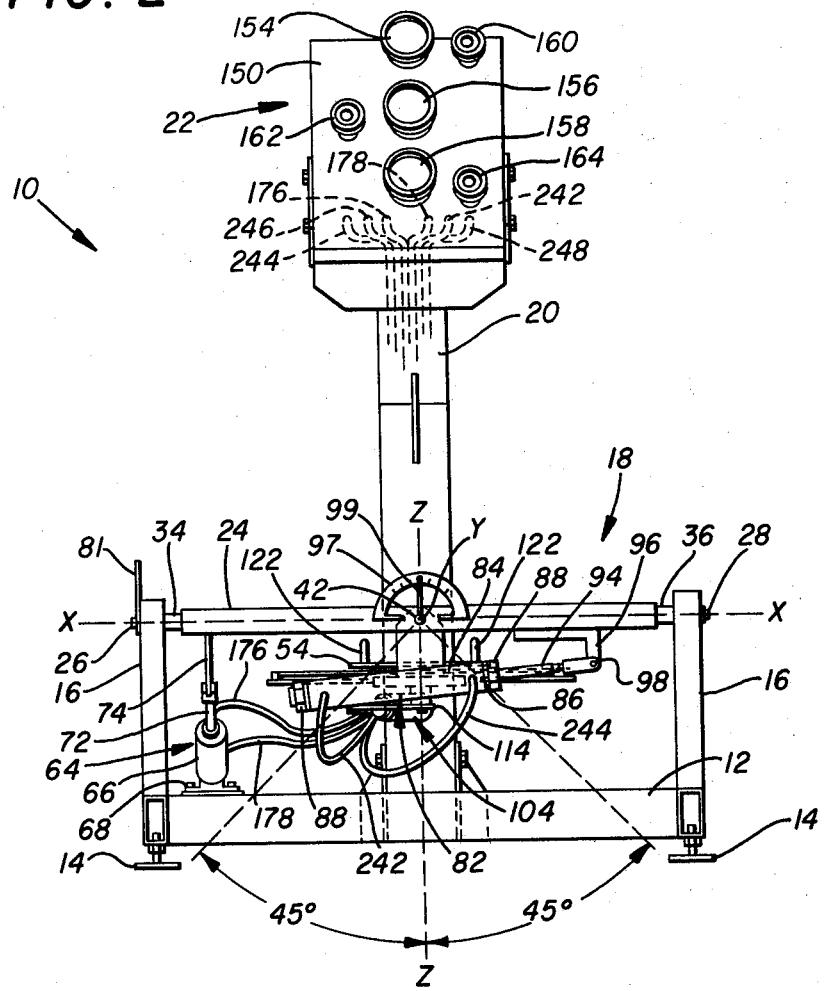
FIG. 2 is an end view of the ankle exerciser.

A second double acting linear fluid cylinder 82 is positioned between main frame 24 and bridge plate 40 to control the motion of the pedal assembly about axis Y—Y. The housing 84 of cylinder 82 is mounted on a bracket 86 by means of nuts 88. The end bracket 86, in turn, is pivoted to bridge plate 40 near its center by pivot pin 90 cooperating with a bushing received within an aperture formed in the bridge plate 40. The exposed end of piston rod 94 of second cyliner 82 is pivotally mounted to an anchor bracket 96 secured to main frame 24 by a pivot pin 98. It is clear that cylinder 82 may control the pivotal motion of the bridge plate 40 about axis Y—Y. A protractor scale 97 may be secured to main frame 24 for cooperation with a pointer 99 on bridge plate 40 to indicate the angle of rotation about axis Y—Y. In the preferred embodiment, the range of motion extends 45° on either side of the vertical center line of the ankle exerciser as shown in FIG. 2.

Figure 3:
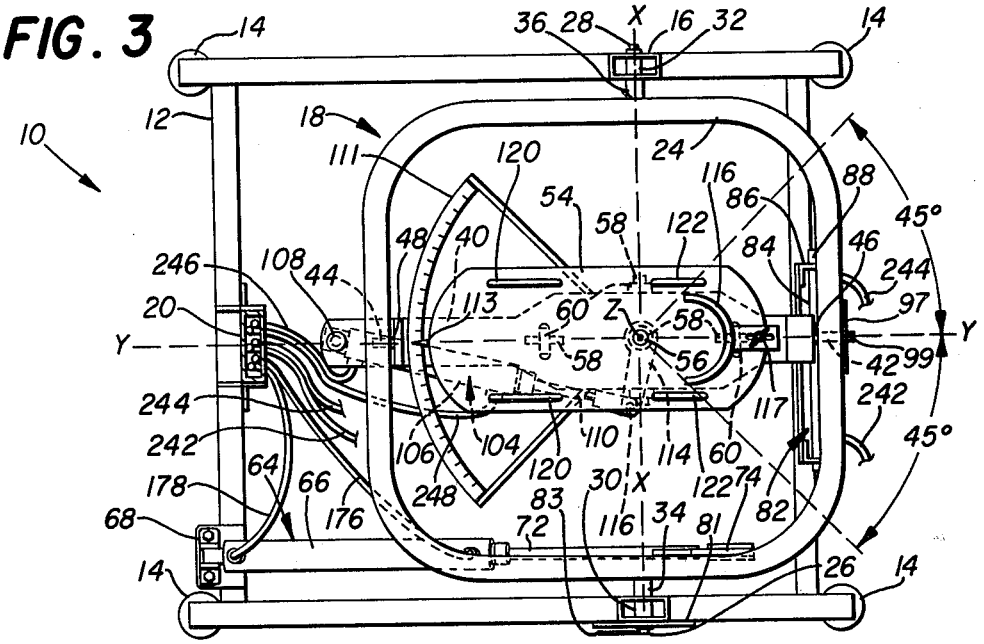
FIG. 3 is a horizontal cross section view of the ankle exerciser taken along line 3—3 in FIG. 1 in the direction of the arrows.

A third double acting linear fluid cylinder 104 is mounted between bridge plate 40 and foot plate 54 to control motion about axis Z—Z. The end of housing 106 of cylinder 104 is pivotally connected to bridge plate 40 by means of a pivot pin 108. The exposed end of piston rod 110 of third cylinder 104 is pivotally connected to a pivot arm 114 by pivot pin 116. The pivot arm 114, in turn, is secured for rotation with the foot plate 54. It is clear that cylinder 104 may control the pivotal motion of the foot plate 54 about axis Z—Z. A protractor scale 111 may be secured to bridge plate 40 for cooperation with pointer 113 on foot plate 54 to indicate the angle of rotation about axis Z—Z. In the preferred embodiment, the foot plate 54 may be pivoted 45° on either side of the horizontal center axis of the ankle exerciser as shown in FIG. 3.

Figure 11:
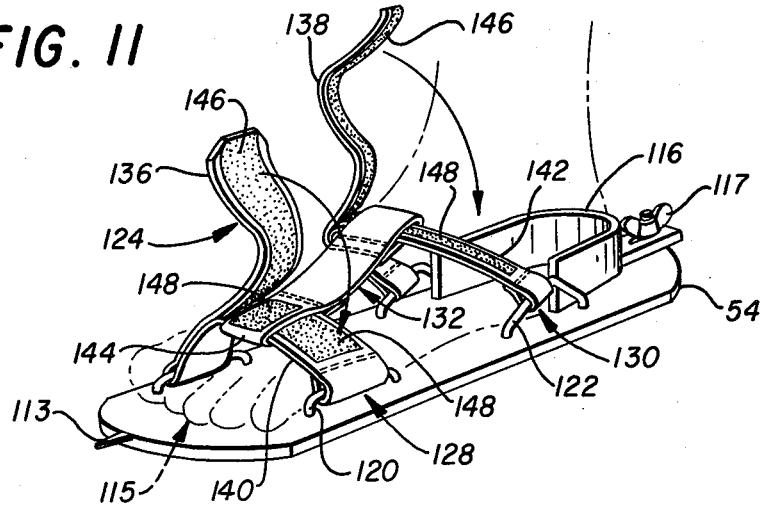
FIG. 11 illustrates the foot plate and strap for securing the foot in both embodiments of the ankle exerciser.

The upper surface of foot plate 54 is designed to permit the sole of a foot 115 to be placed thereon, between strap anchors 120 and 122 as shown in FIG. 11. An adjustable heel support 116 is mounted on foot plate 54 which may be adjusted to adapt the plate 54 for use with a range of foot sizes. The heel support is adjusted by loosening wing nut 117, moving the heel support to the correct position and retightening the nut 117. A strap 124 is provided for securing the foot onto foot plate 54. This strap is fully adjustable to permit a wide range of foot sizes to be used with the ankle exerciser 10.

The strap 124 includes a toe strap 128 and an instep strap 130 joined by a connecting strap 132. Toe strap 128 and instep strap 130 are permanently jointed at one end to a anchor 120 and 122 respectively. To secure foot 115 to plate 54, the foot is first positioned in the desired location on plate 54. The foot should be positioned so that the axis of motion of the ankle joint in dorsal and plantar flexion corresponds substantially to axis X—X. Heel support 116 may then be adjusted to contact the heel of foot 115. The free end of each strap 128 and 130 is inserted through the free anchors 120 and 122 and drawn tight to hold the foot. Fastening means are provided to secure the excess lengths 136 and 138 of straps 128 and 130 to the portions 140 and 142 of straps 128 and 130 contacting the foot and the top 144 of connecting strap 132 to secure the foot during exercise. In the preferred embodiment, the excess lengths 136 and 138 are provided with strips 146 of flexible hook-like members for fastening to strips 148 of a felt-like material or receptor hooks. Strips 146 and 148 may be of the type marketed under the trademark Velcro. The provision of strip 148 on the upper portion of connecting strap 132 permits the strap 132 to be centered in the middle of the foot and anchored in this position for best support over a range of foot sizes.

Fluid lines 176, 178, 240, 242, 244 and 246 extend from the fluid cylinders 64, 82 and 104 from the chambers defined on either side of the piston heads on piston rods 72, 94 and 110. The six fluid lines are routed within the control column 20 to the control panel 22. This prevents injury to the fluid lines and also provides a pleasing exterior appearance to the ankle exerciser 10.

Figure 4:
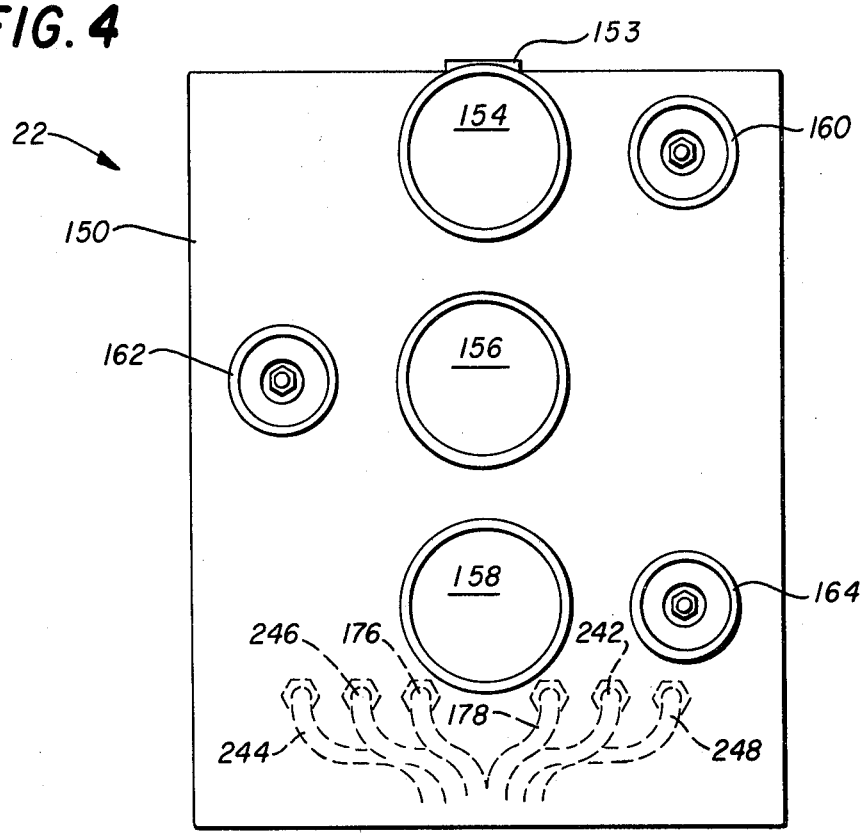
FIG. 4 is an oblique frontal view of the ankle exerciser illustrating the control circuit along line 4—4 in FIG. 1 in the direction of the arrows.

The control panel 22, as shown in FIG. 4, comprises generally a manifold 150 having a number of fluid passages formed therein, a reservoir 152 having a fill cap 153 for containing fluid and instruments for controlling and monitoring the fluid flow. In the preferred embodiment, the manifold 150 is formed from a solid piece of suitable material, such as metal, and the fluid passages are formed therein by drilling the passages and tapping the exposed ends of the passages for plugging or connection to fluid lines and instruments. Pressure gauges 154, 156 and 158 are mounted on the manifold 150 to indicate the highest pressure in a chamber of cylinders 64, 82 and 104, respectively. Metering valves 160, 162 and 164 are provided for restricting the fluid flow from the chamber in cylinders 64, 82 and 104, respectively, having the highest pressure.

Figure 5:
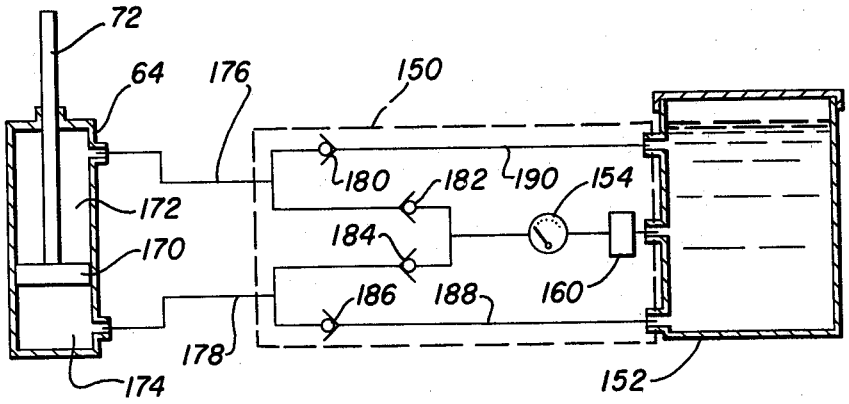
FIG. 5 is a schematic of the fluid circuit for a cylinder in the exercise device.

The operation of cylinders 64, 82 and 104 and associated fluid controls will be described by reference to cylinder 64 and its associated fluid controls as schematically illustrated in FIG. 5. It will be understood that the cylinders 82 and 104 and associated controls are substantially identical. The cylinder 64 includes a piston head 170 secured to piston rod 72 to define two chambers 172 and 174 within the cylinder. Hydraulic lines 176 and 178 extend from chambers 172 and 174, respectively, through the control column 20 and are secured to manifold 150.

As the piston rod 72 is pulled outwardly to decrease the volume of chamber 172, the fluid pressure in chamber 172 increases and fluid is forced out through line 176. The fluid pressure closes a check valve 180 and opens a check valve 182. Check valve 184 in fluid line 178 is maintained in the closed position as the fluid pressure in the line 176 is substantially greater than the fluid pressure in line 178. The pressurized fluid from fluid line 176 flows through pressure gauge 154 and metering valve 160 prior to entry into the fluid reservoir 152. The metering valve 160 may be adjusted to provide the desired resistance to the flow of the fluid through line 176 and out of chamber 172. During this motion, the chamber 174 is increasing in volume, lowering the fluid pressure within chamber 174 and line 178. This causes the check valve 186 to open and fluid from the reservoir 152 passes into the chamber 174 through passage 188 and 178.

When piston rod 72 is forced into the cylinder housing, the fluid within chamber 174 becomes pressurized. The fluid opens the check valve 184 and flows through pressure gauge 154 and metering valve 160. During this process, check valve 182 and 186 are maintained in the closed position. The fluid pressure within chamber 172 decreases, opening check valve 180 and permitting fluid to flow through passage 190 and line 176 from the reservoir 152 to chamber 172.

It is clear from the above description and FIG. 4 that the resistance to motion of the piston rods 72, 94 and 110 within cylinder 64, 82 and 104 may be varied by adjusting the metering valves 160, 162 and 164. The fluid pressure within the chamber being reduced in volume by the movement of the piston rod may be measured on the pressure gauges 154, 156 and 158. When the foot of the user of ankle exerciser 10 is properly positioned on foot plate 54 and secured thereto by strap 124, the axis X—X will essentially correspond to the axis of pivotal motion of the ankle joint in dorsal and plantar flexion. The pivotal motion about axis Y—Y will correspond substantially to the axis of pivotal motion of the foot during inversion and eversion. Finally, the axis Z—Z will correspond substantially to the axis of pivotal motion of the foot and ankle joint when rotated by the lower leg of the user.

It will thus be apparent that the user may isokinetically exercise the foot in dorsal and plantar flexion by adjusting the resistance to fluid flow through metering valve 160. The force exerted by the user in dorsal and plantar flexion will be represented by the fluid pressure measured by pressure gauge 154. Similarly, the user may provide an isokinetic exercise for inversion and eversion by adjusting metering valve 162 with the force exerted being represented by the fluid pressure measured by pressure gauge 156. Finally, the ankle and lower leg may be isokinetically exercised by adjusting the metering valve 164 to provide a desired resistance to rotation of the foot and ankle joint and the force exerted during rotation represented by the reading on pressure gauge 158.

The positioning of the three mutually perpendicular axes X—X, Y—Y, and Z—Z substantially on the natural axes of motion of the ankle and foot of the user insures that the motion of the foot within the ankle exerciser 10 is completely natural. The ability of the foot to move within three dimensions on ankle exerciser 10 eliminates any artificial restraint on the motion of the foot which could aggravate or result in injury. However, if desired, the ankle exerciser 10 may be modified to include only two separate axes of rotation or even a single axis.

The structure and operation of ankle exerciser 10 is identical in several aspects to that of the ankle machine disclosed in Applicants' co-pending application Ser. No. 172,184, filed July 25, 1980. In principle, the hydraulic cylinder 29, piston shaft 30, ball-type regulator 60 with control handle 57, and gauges 55 and 56 of application Ser. No. 172,184 operate in a manner similar to cylinder 64, piston rod 72 and control panel 22 of the present invention in permitting adjustable resistance to motion in plantar and dorsal flexion. The pedal 35 of application Ser. No. 172,184 corresponds substantially to foot plate 54 of the present invention. The devices 15 and pads 16 of application Ser. No. 172,184 corresponds to feet 14 The lateral members 10 and parallel from members 11 of application Ser. No. 172,184 correspond to frame 12 of the present invention and frame members 13 correspond to members 16 of the present invention.

FIGS. 6–10 illustrate an ankle exerciser 250 forming a second embodiment of the present invention. The ankle exerciser 250 is adapted for use with both feet of the user and permits dorsal and plantar flexion of the ankle joints with independent variation of the resistant forces in dorsal and plantar flexion.

Figure 6:
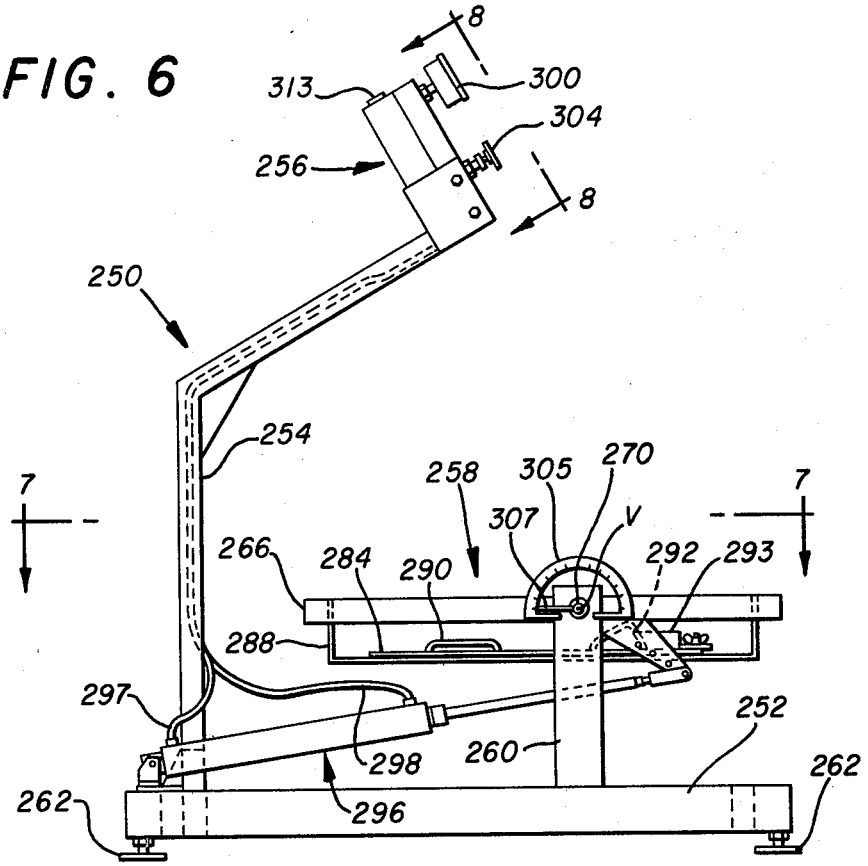
FIG. 6 is a side view of an ankle exerciser forming a second embodiment of the present invention.

As shown in FIG. 6, the ankle exerciser 250 includes a support frame 252, a control column 254 extending upwardly to a control panel 256 and a pedal assembly 258 pivotally mounted to verticaly extending members 260 of support frame 252 for pivotal motion about an axis V—V. The support frame 252 is supported on a surface by means of adjustable feet 262 located at the four corners of the frame.

The pedal assembly 258 includes a main frame member 266 which is pivotally connected to the members 260 by means of pivot shafts 268 and 270 interacting with bushings 272 and 274 within apertures formed in the members 260. Bushings 276 and 278 may be provided between members 260 and main frame 266 to properly space the main frame. Foot plates 282 and 284 are positioned within the outer perimeter of the main frame 266 and rigidly secured thereto by members 286 and 288. The foot plates 282 and 284 include strap anchors 290 and 292 and heel support 293 in a manner similar to anchors 120 and 122 and heel support 116 of foot plate 54. Straps identical to strap 124 are provided on each of the foot plates 282 and 284 for securing a foot thereon in the identical manner as strap 124. The foot plates 282 and 284 are generally aligned so that the feet of the user, sitting in front of the ankle exerciser 250, may be naturally positioned on foot plates 282 and 284. The foot plates 282 and 284 are mounted to main frame 266 at a level below the axis V—V so that the axis V—V substantially corresponds to the axis of rotation of the ankle joint of the feet of the user in dorsal and plantar flexion.

With reference again to FIG. 6, a double acting linear fluid cylinder 296 is secured between the rear portion of support frame 252 and main frame 266 in a manner similar to the cylinder 64 in ankle exerciser 10. The fluid cylinder 296 will then control the pivotal motion of the main frame 266 about the axis V—V. A protractor scale 305 is mounted on a member 260 for cooperation with a pointer 307 secured to shaft 270 to indicate the tilt of pedal assembly 258.

Fluid lines 297 and 298 are connected to both chambers of fluid cylinder 296 defined on either side of the piston head within the cylinder and extend through the control column 254 to control panel 256.

Figure 8:
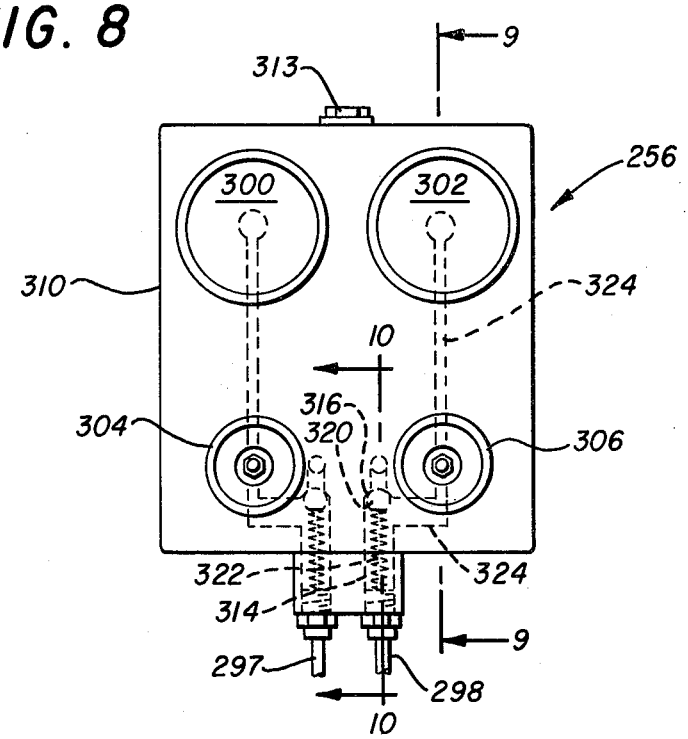
FIG. 8 is an oblique frontal view of the ankle exerciser illustrating the control circuit of the ankle exercise of FIG. 6 taken along line 8—8 in FIG. 6 in the direction of the arrows.

FIG. 8 illustrates the instruments mounted on the control panel 256. Pressure gauges 300 and 302 are provided to measure the fluid pressure within the chambers on either side of the piston head within fluid cylinder 296. The metering valves 304 and 306 are provided to control the resistance to fluid flow from a chamber within the fluid cylinder 296 to resist rotation of the pedal assembly about axis V—V.

Figure 9:
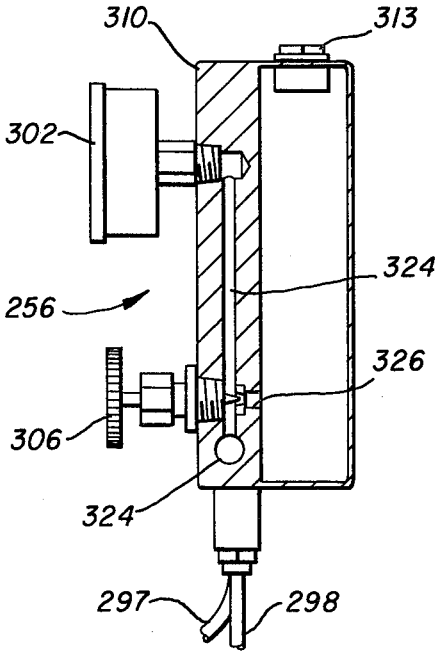
FIG. 9 is a cross sectional view of the control circuit of FIG. 8 along line 9—9 in FIG. 8 in the direction of the arrows.
Figure 10:
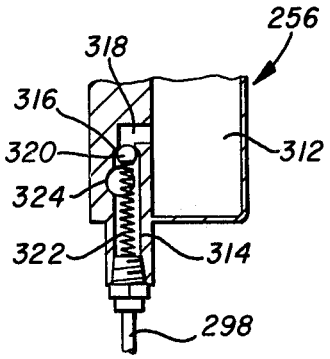
FIG. 10 is a partial cross sectional view of the control circuit of FIG. 8 along line 10—10 in FIG. 8 in the direction of the arrows.
Figure 7:
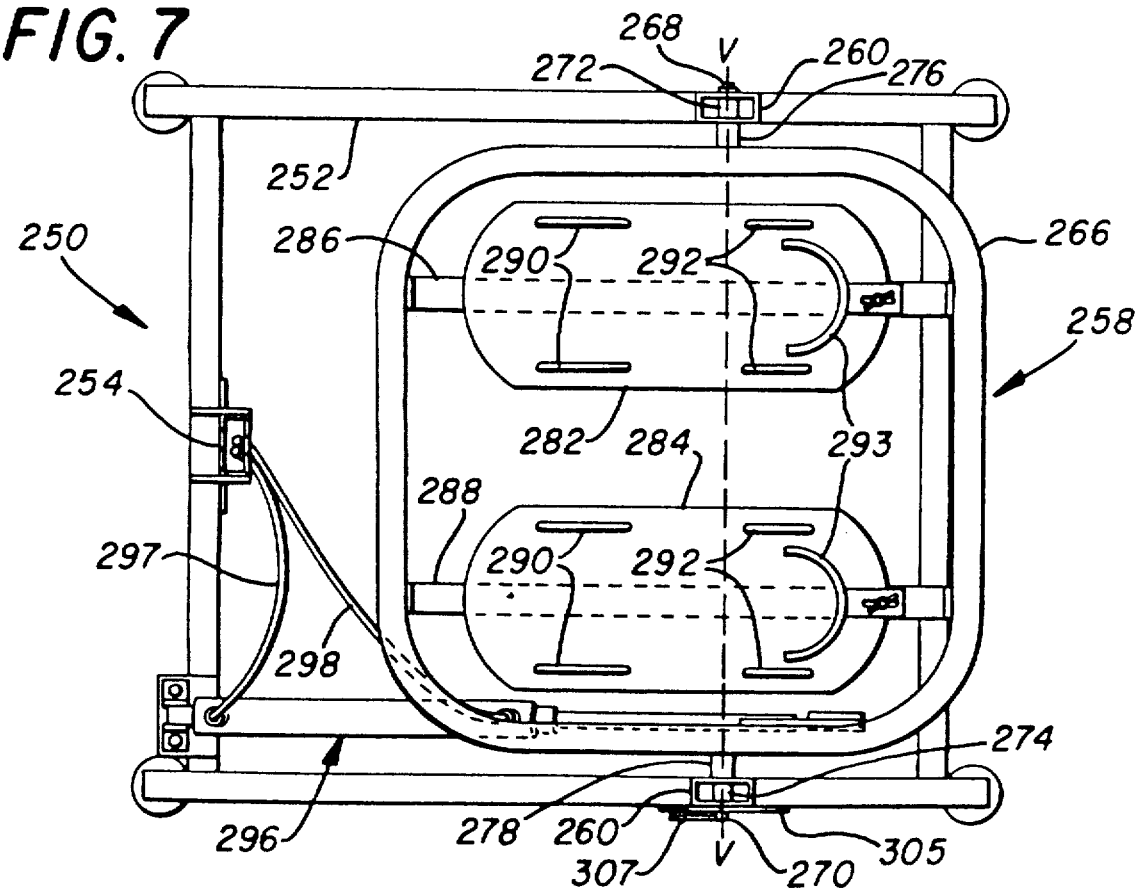

The control panel 256 comprises a manifold 310 and reservoir 312 having a fill cap 313 as best illustrated in FIGS. 9 and 10. FIGS. 9 and 10 illustrate one flow circuit in manifold 310, the other flow circuit is substantially identical. FIG. 10 illustrates a partial cutaway view to indicate the fluid passges formed within the manifold 310. The fluid line 298 from the pistion rod side of the piston head within cylinder 296 is secured at the opening of a passage 314 within manifold 310. Passage 314 includes a conical seal face 316 and a passage 318 into the reservoir 312. A check valve ball 320 is urged against the conical seal face 316 by a spring 322. As shown in FIG. 9, a connecting passage 324 leads to the metering valve 306 which also includes a passage 326 for metering fluid into the reservoir 312, Passage 324 also connects with the pressure gauge 302. If the feet of the user are rotated in plantar flexion, the chamber on the piston side of the piston head will decrease, thereby increasing the fluid pressure therein and within the fluid line 298 attached to passage 314. The fluid pressure will maintain the ball 320 against seal face 316 and prevent the fluid flow through aperture 318. The resistance to motion of the piston rod within the cylinder will be determined by the setting on the metering valve 306, which permits a limited amount of fluid to pass through passage 326 into the reservoir. The fluid pressure measured by pressure gauge 306 will indicate the force exerted by the user during plantar flexion. During plantar flexion, a similar check valve ball in the other flow circuit in manifold 310 will move out of engagement with a seal face, permitting fluid from the reservoir to flow through the fluid line into the chamber on the opposite side of the piston head. In dorsiflexion, the flow paths are reversed and the resistance to dorsiflexion may be determined by the setting on metering valve 304 and force exerted measured on pressure gauge 300.

The ankle exerciser 250 therefore permits isokinetic exercise of the ankle joint of a user in both dorsal and plantar flexion with the resistance to motion in either direction being independently controlled by metering valves 304 and 306. The positioning of axis V—V substantially coincident with the axis of rotation of the ankle joints of the user provide a natural motion during exercise. While not shown, it would be obvious from the teachings contained herein to provide motion in three mutually perpendicular axes to permit dorsal and plantar flexion, inversion and eversion and rotation of the feet of the feet and ankle joints of the user.

Although two embodiments of the invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

We claim:

1. An apparatus for exercising the ankle of a user comprising:

a frame;

a pedal assembly pivotally mounted to said frame for motion about at least a first axis, said pedal assembly including strap means for securing a foot of the user thereon, the axis of pivotal motion of said pedal assembly substantially corresponding to the axis of motion of the ankle joint in dorsal and plantar flexion;

a first double acting fluid structure having first and second fluid chambers therein interconnected between said frame and said pedal assembly for resisting the pivotal motion of said pedal assembly about said first axis;

a fluid reservoir;

a first fluid flow restrictor for restricting fluid flow therethrough;

first flow means for permitting fluid flow between each chamber of said first fluid structure and said reservoir, said first flow means permitting flow from said reservoir to a chamber in said first fluid structure when the fluid pressure in the chamber is less than the fluid pressure is said reservoir, said first flow means requiring fluid from a chamber having a fluid pressure greater than the pressure in said reservoir to flow through said first fluid flow restrictor so that the pivotal motion of said pedal assembly is restricted by the restriction of flow through said first fluid flow restrictor; and a second fluid flow restrictor for restricting fluid flow therethrough, said first flow means requiring fluid from said first chamber of said first fluid structure to flow through said first flow restrictor and fluid from said second chamber to flow through said second fluid flow restrictor permitting the resistance to motion of said pedal assembly in opposite directions about said first axis to be dissimilar, the restriction to flow through said first and second fluid flow restrictors permitting the selection of the resistance to motion in either direction independently of the opposite direction so that the force necessary to pivot said pedal assembly by dorsal and plantar flexion of the ankle joint of the user can be independently controlled, said pedal assembly including strap means for securing both feet of the user thereon in a generally aligned manner to exercise both ankles of the user.

2. The apparatus of claim 1 wherein said pedal assembly includes strap means for securing both feet of the user thereon in a generally aligned manner to exercise both ankles of the user.

3. The apparatus of claim 1 further comprising sensing means for sensing the force exerted by the user to pivot said pedal assembly in each direction about said first axis.

4. The apparatus of claim 1 further comprising sensing means for sensing the force exerted by the user to pivot said pedal assembly about said first axis.

5. An apparatus for exercising the ankle of a user comprising:

a frame;

a pedal assembly pivotally mounted to said frame for motion about at least a first axis, said pedal assembly including strap means for securing a foot of the user thereon, the axis of pivotal motion of said pedal assembly substantially corresponding to the axis of motion of the ankle joint in dorsal and plantar flexion;

a first double acting fluid structure having first and second fluid chambers therein interconnected between said frame and said pedal assembly for resisting the pivotal motion of said pedal assembly about said first axis;

a fluid reservoir;

a first fluid flow restrictor for restricting fluid flow therethrough;

first flow means for permitting fluid flow between each chamber of said first fluid structure and said reservoir, said first flow means permitting flow from said reservoir to a chamber in said first fluid structure when the fluid pressure in the chamber is less than the fluid pressure in said reservoir, said first flow means requiring fluid from a chamber having a fluid pressure greater than the pressure in said reservoir to flow through said first fluid flow restrictor so that the pivotal motion of said pedal assembly is restricted by the restriction of flow through said first fluid flow restrictor; and said pedal assembly being pivotally mounted to said frame for motion about first and second mutually perpendicular axes, said pedal assembly further comprising resistance means for resisting the pivotal motion of said pedal assembly about the second axis and control means for permitting independent selection of the resistance to motion about said second axis by said resistance means.

6. The apparatus of claim 5 further comprising sensing means for sensing the force exerted by the user to pivot said pedal assembly about each of said axes.

7. The apparatus of claim 5 wherein said second pivotal axis corresponds substantially to the axis of motion of the foot of the user during rotation of the foot and ankle joint.

8. The apparatus of claim 5 wherein said second axis of rotation corresponds substantially to the axis of motion of the foot of the user during inversion and eversion.

9. The apparatus of claim 5 wherein said pedal assembly is pivotally mounted to said frame for motion about a third axis perpendicular to said first and second axes, said second axis corresponding substantially to the axis of motion of the foot during rotation of the foot and ankle joint and said third axis corresponding substantially to the axis of motion of the foot during inversion and eversion, said apparatus further comprising second resistance means for resisting the pivotal motion of said pedal assembly about said third axis, said second resistance means permitting the resistance to motion about said third axis to be independently determined and said apparatus further comprising second control means for selecting the resistance to motion about said third axis by said second resistance means.

10. The apparatus of claim 9 further comprising sensing means for sensing the force exerted by the user to pivot said pedal assembly about each of said axes independently.

11. An apparatus for exercising the ankle of a user comprising:

a frame;

a pedal assembly including strap means for securing the foot of the user thereto, said pedal assembly being pivotally mounted to said frame for pivotal motion about at least a first axis, said first axis corresponding substantially to the axis of pivotal motion of the ankle joint during dorsal and plantar flexion;

a first double acting fluid cylinder having first and second fluid chambers interconnected between said frame and said pedal assembly for resisting the pivotal motion of said pedal assembly about said first axis;

a fluid reservoir;

a first fluid flow restrictor for restricting fluid flow therethrough;

first flow means for permitting fluid flow between each chamber of said first fluid cylinder and said reservoir, said first flow means permitting flow from said reservoir to a chamber in said first fluid cylinder when the fluid pressure in the chamber is less than the fluid pressure is said reservoir, said first flow means requiring fluid from a chamber having a fluid pressure greater than the pressure in said reservoir to flow through said first flow restrictor so that the pivotal motion of said pedal assembly is resisted by the restriction of flow through said first flow restrictor; and a second flow restrictor for restricting fluid flow therethrough, said first flow means requiring fluid from said first chamber of said first fluid cylinder to flow through said first flow restrictor and fluid from said second chamber to flow through said second flow restrictor so that the resistance to pivotal motion of said pedal assembly in one direction is independent of the resistance in the opposite direction, said pedal assembly including strap means for securing both feet of the user thereto in a generally aligned manner, said first axis corresponding substantially to the axis of pivotal motion of the ankle joints of the feet during dorsal and plantar flexion.

12. The apparatus of claim 11 further comprising gauge means for measuring the fluid pressure within each chamber of said first fluid cylinder when fluid is flowing either through said first or second flow restrictor to indicate the force exerted by the user to pivot said pedal assembly about said first axis.

13. The apparatus of claim 11 further comprising gauge means for measuring the fluid pressure in a chamber of said first fluid cylinder when fluid flows from the chamber in said first fluid cylinder through said first flow restrictor to indicate the force exerted by the user to pivot said pedal assembly.

14. An apparatus for exercising the ankle of a user comprising:

a frame;

a pedal assembly including strap means for securing the foot of the user thereto, said pedal assembly being pivotally mounted to said frame for pivotal motion about at least a first axis, said first axis corresponding substantially to the axis of pivotal motion of the ankle joint in dorsal and plantar flexion;

a first double acting fluid cylinder having first and second fluid chambers interconnected between said frame and said pedal assembly for resisting the pivotal motion of said pedal assembly about said first axis;

a fluid reservoir;

a first fluid flow restrictor for restricting fluid flow therethrough;

first flow means for permitting fluid flow between each chamber of said first fluid cylinder and said reservoir, said first flow means permitting flow from said reservoir to a chamber in said first fluid cylinder when the fluid pressure in the chamber is less than the fluid pressure is said reservoir, said first flow means requiring fluid from a chamber having a fluid pressure greater than the pressure in said reservoir to flow through said first flow restrictor so that the pivotal motion of said pedal assembly is resisted by the restriction of flow through said first flow restrictor; and said pedal assembly including strap means for securing both feet of the user thereto in a generally aligned manner, said first axis corresponding substantially to the axes of pivotal motion of the ankle joints of the feet during dorsal and plantar flexion.

15. An apparatus for exercising the ankle of a user, comprising:

a frame;

a pedal assembly including strap means for securing the foot of the user thereto, said pedal assembly being pivotally mounted to said frame for pivotal motion about at least a first axis, said first axis corresponding substantially to the axis of pivotal motion of the ankle joint during dorsal and plantar flexion;

a first double acting fluid cylinder having first and second chambers interconnected between said frame and said pedal assembly for resisting the pivotal motion of said pedal assembly about said first axis;

a fluid reservoir;

first restriction means for restricting fluid flow therethrough;

first flow means for permitting fluid flow between each chamber of said first fluid cylinder and said reservoir, said first flow means permitting flow from said reservoir to a chamber in said first fluid cylinder when the fluid pressure in the chamber is less than the fluid pressure in said reservoir, said first flow means requiring fluid from a chamber having a fluid pressure greater than the pressure in said reservoir to flow through said first restriction means so that the pivotal motion of said pedal assembly is resisted by the restriction of flow through said first restriction means;

said pedal assembly further being pivotally mounted to said frame for pivotal motion about a second axis perpendicular to said first axis;

a second double acting fluid cylinder interconnected between said frame and said pedal assembly for resisting the pivotal motion of said pedal assembly about said second axis;

second restriction means for restricting fluid flow therethrough; and said flow means for permitting fluid flow between each chamber of said second fluid cylinder and said reservoir, said second flow means permitting flow from said reservoir to a chamber in said second fluid cylinder when the fluid pressure in the chamber is less than the fluid pressure in said reservoir, said second flow means requiring fluid from a chamber having a fluid pressure greater than the pressure in said reservoir to flow through said second restriction means so that the pivotal motion of said pedal assembly about said second axis is resisted by the restriction of flow through said second restriction means.

16. The apparatus of claim 15 further comprising first and second gauge means for indicating the fluid pressure in a chamber in said first and second fluid cylinder when fluid from the chamber flows through said first and second restriction means, respectively.

17. The apparatus of claim 15 wherein said second axis corresponds substantially to the axis of pivotal motion of the foot during inversion and eversion.

18. The apparatus of claim 15 wherein said second axis corresponds substantially to the axis of pivotal motion of the foot and ankle joint during rotation.

19. The apparatus of claim 15 wherein said pedal assembly is pivotally mounted to said frame for pivotal motion about a third mutually perpendicular axis, said apparatus further comprising:

a third double acting fluid cylinder interconnected between said frame and said pedal assembly for resisting the pivotal motion of said pedal assembly about said third axis;

third restriction means for restricting fluid flow therethrough; and third flow means for permitting fluid flow between each chamber of said third fluid cylinder and said reservoir, said third flow means permitting flow from said reservoir to a chamber in said third fluid cylinder when the fluid pressure in the chamber is less than the fluid pressure in said reservoir, said third flow means requiring fluid from a chamber in said third fluid cylinder having a fluid pressure greater than the pressure in said reservoir to flow through said third restriction means so that the pivotal motion of said pedal assembly about said third axis is resisted by the restriction of flow through said third restriction means, said second axis corresponding substantially to the axis of pivotal motion of the foot during inversion and eversion and said third axis corresponding substantially to the axis of pivotal motion of the foot and ankle joint during rotation.

20. The apparatus of claim 19 further comprising first, second and third gauge means for measuring the fluid pressure in the chamber of said first, second and third fluid cylinders having fluid flowing through said first, second and third restriction means, respectively, for indicating the resistance to motion about said first, second and third axes.

21. An apparatus for isokinetic exercise of an ankle of a user comprising:

a frame;

a pedal assembly pivotally mounted to said frame for pivotal motion about first, second and third mutually perpendicular axes and including strap means for securing the foot thereon, said first axis corresponding substantially to the axis of pivotal motion of the ankle joint in dorsal and plantar flexion, said second axis corresponding substantially to the axis of pivotal motion of the foot in inversion and eversion and said third axis corresponding substantially to the axis of pivotal motion of the ankle joint and foot in rotation;

first, second and third double acting fluid cylinders for resisting motion in said pedal assembly about said first, second and third axes, respectively;

a fluid reservoir; and first, second and third fluid control circuits associated with said first, second and third fluid cylinders, respectively, each of said fluid control circuits comprising a metering valve, a fluid pressure gauge and fluid lines extending from opposed chambers in the associated fluid cylinder, each of said fluid lines having a check valve permitting flow into a chamber from said reservoir when the fluid pressure within the chamber is less than the fluid pressure within said reservoir and a check valve permitting flow from the chamber through the metering valve and fluid pressure gauge to said reservoir when the fluid pressure in the chamber exceeds the fluid pressure within said reservoir so that as the user attempts to pivot said pedal assembly about any of said first, second and third axes, the associated fluid control circuit resists the motion in an isokinetic manner, the force exerted by the user to pivot said pedal assembly about each of said first, second and third axes being represented by the fluid pressure measured by the fluid pressure gauges.

22. An apparatus for exercising the ankles of a user comprising:

a frame;

a pedal assembly including strap means for securing the feet of the user thereto, said pedal assembly being pivotally mounted to said frame for motion about an axis generally corresponding to the axes of pivotal motion of the ankle joints of the user in dorsal and plantar flexion when the feet of the user are secured to said pedal assembly;

a double acting fluid cylinder interconnected between said frame and said pedal assembly for resisting the pivotal motion of said pedal assembly about said axis;

first and second fluid lines extending from opposed first and second chambers in said fluid cylinder;

a control panel comprising a manifold receiving said first and second fluid lines, a fluid reservoir, first and second metering valves and first and second pressure gauges, said manifold permitting flow from the reservoir to the first chamber when the fluid pressure in the first chamber is less than the fluid pressure in the reservoir and directing flow through the first metering valve and first pressure gauge when the fluid pressure within the first chamber exceeds the fluid pressure in the reservoir, the manifold permitting fluid flow to the second chamber from the reservoir when the fluid pressure in the second chamber is less than the fluid pressure in the reservoir and directing fluid flow through the second metering valve and second pressure gauge when the fluid pressure within the second chamber exceeds the fluid pressure in the reservoir so that the resistance to motion of the pedal assembly in either direction may be independently controlled by the user by regulating the first and second metering valves and the force exerted by the user to pivot said pedal assembly being represented by the reading on the first and second pressure gauges.

* * * * *

UNITED STATES PATENT AND TRADEMARK OFFICE

CERTIFICATE OF CORRECTION

PATENT NO. : 4,452,447

DATED : June 5, 1984

INVENTOR(S) : Chelsea Lepley et al.

It is certified that error appears in the above-identified patent and that said Letters Patent is hereby corrected as shown below:

Column 6, line 20, "corresponds" should read -- correspond--.

Column 6, line 34, "verticaly" should read -- vertically --.

Column 7, line 29, "312", should read -- 312. --.

Signed and Sealed this

*Twelfth* Day of *March 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,452,447

DATED : June 5, 1984

INVENTOR(S) : Chelsea Lepley and J. Scott LaCroix

It is certified that error appears in the above-identified patent and that said Letters Patent is hereby corrected as shown below:

Column 2, line 55, change "illustrates" to --illustrate--.

Column 4, line 40, change "Fluid lines 176, 178, 240, 242, 244 and 246" to --Fluid lines 176, 178, 242, 244, 246 and 248--.

Column 6, line 21, after "14", insert --.--.

Column 6, line 21, change "from" to --form--.

Figure 7:
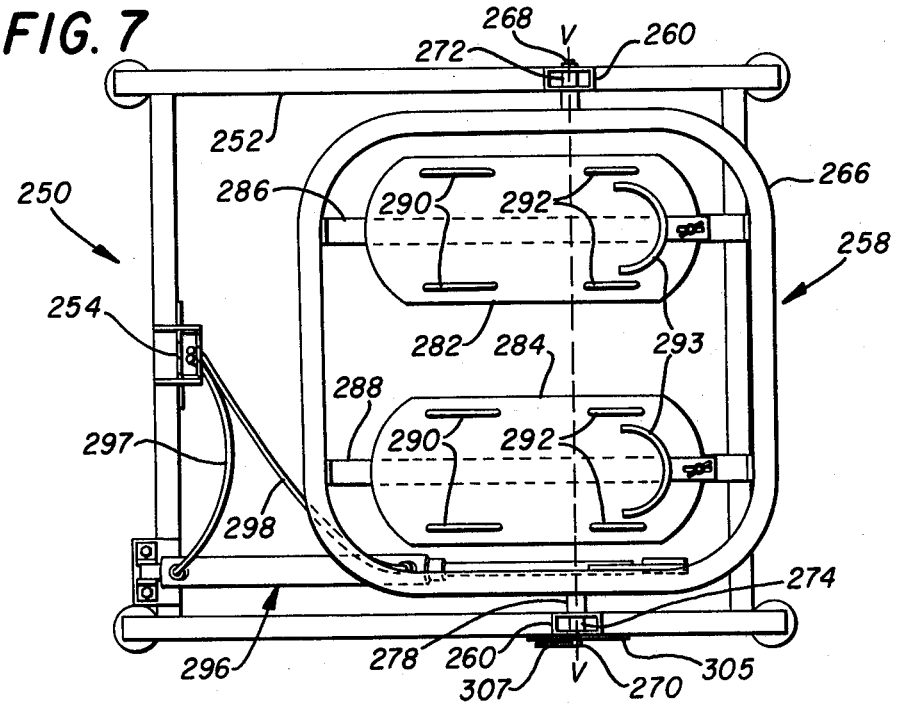
FIG. 7 is a horizontal cross section view of the ankle exerciser of FIG. 6 taken along line 7—7 in FIG. 6 in the direction of the arrows.

Figure 7 should be deleted to appear as per attached Figure 7.

Signed and Sealed this

*Thirteenth* Day of *August 1985*

[SEAL]

*Attest:*

DONALD J. QUIGG

*Attesting Officer*

*Acting Commissioner of Patents and Trademarks*